US007097378B2

(12) United States Patent
Peleman

(10) Patent No.: US 7,097,378 B2
(45) Date of Patent: Aug. 29, 2006

(54) ACCESSORY FOR A WRITING BOARD, FILE OR THE LIKE WHICH IS EQUIPPED WITH SUCH AN ACCESSORY

(75) Inventor: Guido Peleman, Puurs (BE)

(73) Assignee: Unibind (Cyprus) Limited, Nicosia (CY)

( * ) Notice: Subject to any disclaimer, the term of this patent is extended or adjusted under 35 U.S.C. 154(b) by 94 days.

(21) Appl. No.: 10/620,780

(22) Filed: Jul. 16, 2003

(65) Prior Publication Data

US 2004/0062593 A1 Apr. 1, 2004

(30) Foreign Application Priority Data

Jul. 18, 2002 (BE) ..... 2002/0448

(51) Int. Cl.
*B42F 13/06* (2006.01)

(52) U.S. Cl. ..... 402/18; 402/58; 402/60; 402/70; 402/72; 402/75; 402/80 R; 24/67.1; 24/67.9; 24/67 R; 24/67 CF; 24/67.11; 24/95; 24/67.5

(58) Field of Classification Search ..... 402/18, 402/58, 60, 70, 72, 75, 80 R; 24/67 R, 95, 24/67.1, 67.9, 67 CF, 67.11
See application file for complete search history.

(56) References Cited

U.S. PATENT DOCUMENTS

| | | | | | |
|---|---|---|---|---|---|
| 1,675,301 | A * | 6/1928 | Dawson | 402/37 |
| 1,769,120 | A * | 7/1930 | Dawson | 402/39 |
| 2,093,041 | A * | 9/1937 | Emery | 402/45 |
| 2,243,535 | A * | 5/1941 | Newman | 402/37 |
| 2,888,934 | A * | 6/1959 | Segal | 402/37 |
| 4,765,768 | A * | 8/1988 | Wright | 402/30 |
| 4,787,595 | A * | 11/1988 | Hegarty | 248/454 |
| 5,116,081 | A * | 5/1992 | Mann, Jr. | 281/36 |
| 5,975,576 | A * | 11/1999 | Vogel | 281/16 |
| 6,431,779 | B1 * | 8/2002 | Moor et al. | 402/73 |
| 6,692,029 | B1 * | 2/2004 | Ke | 281/21.1 |
| 6,732,419 | B1 * | 5/2004 | Davis | 29/450 |
| 6,746,171 | B1 * | 6/2004 | Welch | 402/36 |
| 2002/0048484 | A1 * | 4/2002 | Tomoda | 402/18 |

FOREIGN PATENT DOCUMENTS

| | | | |
|---|---|---|---|
| EP | 0371860 | A2 * | 11/1989 |
| EP | 371860 | A2 * | 6/1990 |
| EP | 0 482 354 | | 9/1991 |
| EP | 482354 | A1 * | 4/1992 |
| EP | 620126 | A1 * | 10/1994 |
| EP | 1382463 | A1 * | 1/2004 |
| WO | WO93/24335 | * | 9/1993 |
| WO | WO93/24335 | * | 12/1993 |
| WO | WO 95/20494 | | 8/1995 |
| WO | WO95/20494 | * | 8/1995 |

* cited by examiner

*Primary Examiner*—Boyer Ashley
*Assistant Examiner*—Mark Henderson
(74) *Attorney, Agent, or Firm*—Wood, Herron & Evans, LLP

(57) ABSTRACT

An accessory for a writing board, a file or the like, characterized in that it at least consists of a holder (4) which can be provided to a file or the like (3) whereby this holder (4) works in conjunction with or can work in conjunction with a binding mechanism (5) of the type comprising elements over which documents (8) that are provided with openings (9) can be threaded on the one hand, and whereby this holder (4) can be manually attached to a file or the like (3) on the other hand.

13 Claims, 5 Drawing Sheets

ACCESSORY FOR A WRITING BOARD, FILE OR THE LIKE WHICH IS EQUIPPED WITH SUCH AN ACCESSORY

BACKGROUND OF THE INVENTION

1. Field of the Invention

The present invention concerns an accessory for a writing board, a file or the like, as well as a writing board, file or the like which is equipped with such an accessory or which is fit, in other words comprises special provisions, to be equipped with such an accessory.

For clarity's sake, we will only mention a file in what follows, by which is meant, as if it were, every support upon which the accessory can be provided.

2. Discussion of the Related Art

It is known that, in order to keep loose documents together, use can be made of a file consisting of a front wall part, a rear wall part connected to it by means of a back part, and at least one inwardly folded flap formed on one of the aforesaid wall parts which is held at a distance from the accompanying wall part via side pieces. When the file is folded open, the loose documents can be slid in the space situated between the flap and the wall part onto which said flap is fixed. By folding up the file, the loose documents are prevented from leaving the space.

It is also known that such files with separate side pieces can be commercialized, which side pieces will have to be mounted later on by the consumer or retailer. This offers the advantage that the whole, formed of the above-mentioned wall parts, the back part and the flap, can be made flat, such that, in view of its commercialization and distribution, the volume to be packed and transported can be reduced to a minimum.

It is also known to mount a binding mechanism with rings on the flap, near its free end, in the factory, so that documents can be stored loosely in the file in the above-mentioned space on the one hand, and documents can also be fixed in the file by means of the binding mechanism on the other hand.

A disadvantage of such a binding mechanism which is permanently fixed on the flap consists in that it takes up a lot of space and that one cannot always be sure that the selected binding mechanism is the right one. Another disadvantage consists in that the fixed binding mechanism on the flap forms an obstacle, so that parcels containing such files are more difficult to pack and to distribute. Especially in the case of files whereby, as mentioned above, use is made of separate connecting pieces to keep said flap at a distance from the accompanying wall part, the major advantage that such files could be packed with a minimum of lost space, is undone so to say by the presence of the binding mechanism.

SUMMARY OF THE INVENTION

The present invention aims an accessory for a file which is in the first place meant to be used with the aforesaid type of file and with which the above-mentioned disadvantages of the ring mechanism which is fixed on the flap can be excluded or at least minimized. In general, however, it also aims an accessory which can be used in combination with other types of files, and which offers several advantages.

To this end, the invention concerns an accessory for a file, characterized in that it at least consists of a holder which can be provided to a file whereby this holder works in conjunction with or can work in conjunction with a binding mechanism of the type containing elements over which documents that are provided with openings can be threaded on the one hand, and whereby this holder comprises means which make it possible to attach it manually to a file on the other hand.

By manually is meant that the holder can be provided to the file by the consumer or the retailer himself, without any machinery, and preferably not any tools either being required.

By making use of a binding mechanism provided on a holder according to the invention, which holder can be provided to a file by the consumer himself or the like, it is clear that several advantages are obtained.

Thus, for example, the consumer can decide himself whether he either or not wishes to equip a file with a binding mechanism.

As holders with binding mechanisms of different nature or size are offered, the user can determine himself what sort of binding mechanism he will equip the file with.

By packing and distributing the actual files on the one hand and the holders with the binding mechanism on the other hand while they are not coupled, the occupied volume can be reduced to a minimum.

Although the present invention can be realized with different types of binding mechanisms, it is clear that it is particularly useful in the case where the binding mechanism is a mechanism of the type which is equipped with rings having a predominantly rigid shape, consisting of at least two parts provided on a base element and which can be moved between an open and a closed position. Such conventional ring binding mechanisms occupy relatively much space as such, and it is particularly useful if they can be transported when dismounted.

The binding mechanism is preferably mounted fixed on the holder, but according to a variant it is not excluded to mount it in a replaceable manner on the holder such that, with only one holder, it is possible to provide several optional binding mechanisms for a file. The binding mechanism can hereby be connected to the holder in any way whatsoever. In case of a fixed connection, it is for example possible to use rivets. In the case of a replaceable system, use can be made of screwed connections, snap-in systems, etc.

The means which make it possible to fix the holder to a file consist in their simplest form of a U-shaped part which is provided over the file edge concerned in a clamping manner, so that the holder can be removed again at any time and can possibly be used with another file.

The above-mentioned means preferably consist of detachable connecting means which, after the accessory has been provided to a file, also make it possible to remove and provide them at any time.

According to the most preferred embodiment, the means which make it possible to fix the holder to a file consist of connecting means providing for a snap-in connection. As a result, the holder can be easily snapped in a file, without any complicated mounting operations being required.

The holder, in particular the above-mentioned means for fixing it to a file, preferably comprises locking means which allow to keep the holder in place in relation to the file, which preferably consist of parts such as pens which can mesh in openings in the file.

The holder can be either or not equally long as the element upon which it is provided.

Naturally, the invention also concerns files which are equipped with a holder and a binding mechanism as described above.

The invention also concerns files which are characterized in that they comprise provisions, in particular openings or the like, which make it possible to equip these files with such an accessory.

BRIEF DESCRIPTION OF THE DRAWINGS

In order to better explain the characteristics of the invention, the following preferred embodiments are described as an example only without being limitative in any way, with reference to the accompanying drawings, in which.

DESCRIPTION OF THE PREFERED EMBODIMENT

Figure 1:
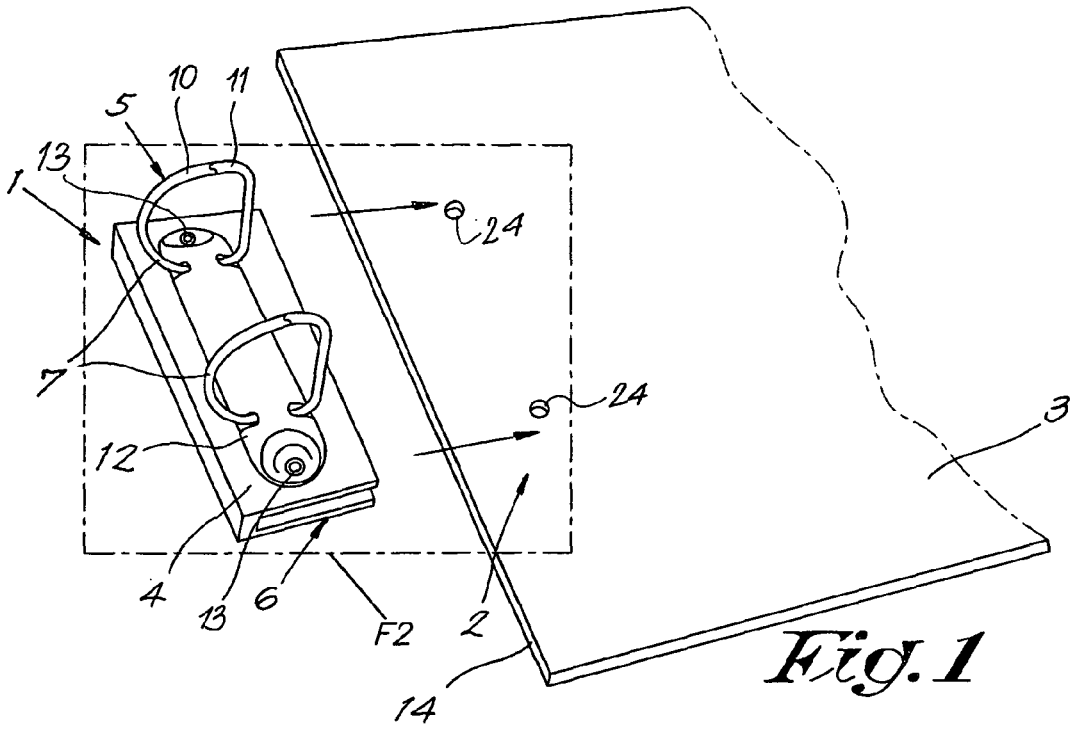
FIG. 1 represents an accessory according to the invention in perspective, together with a wall part of a file with which it can co-operate.
Figure 2:
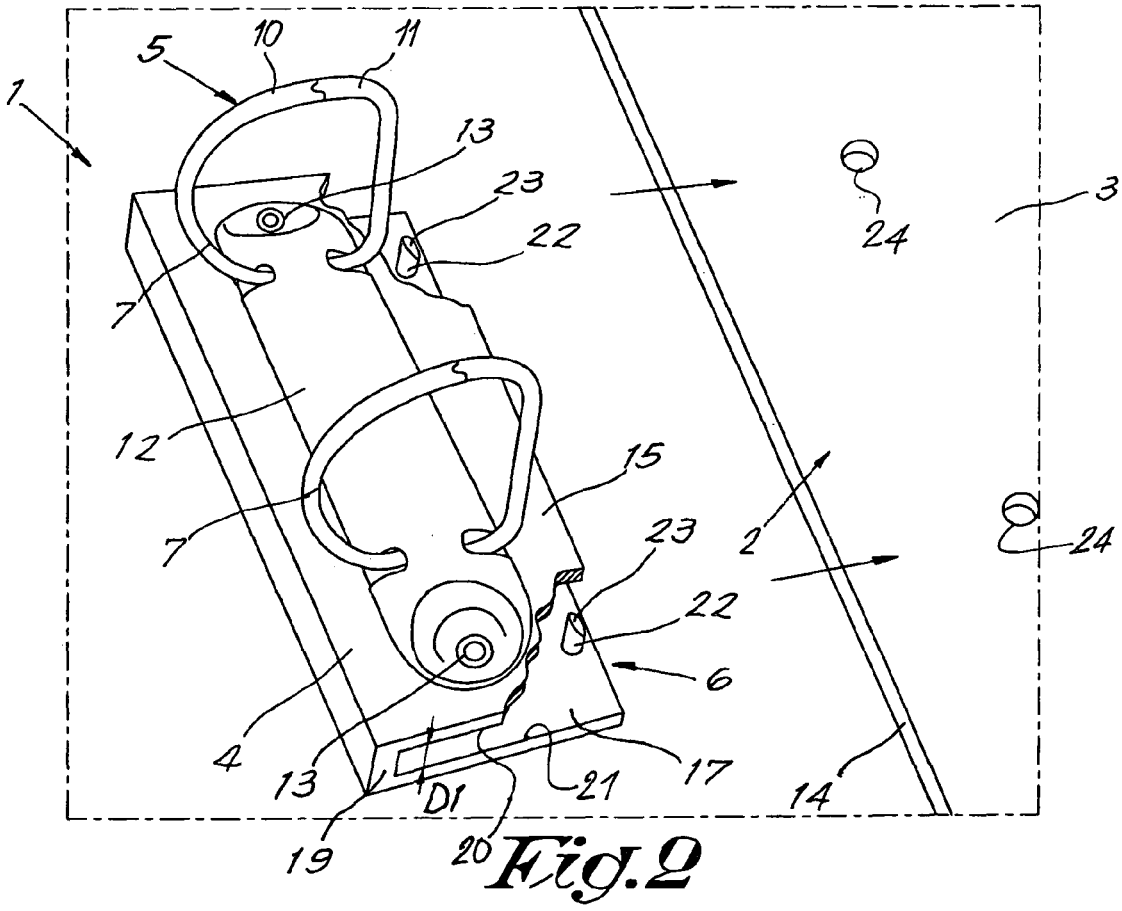
FIG. 2 represents the part indicated by F2 in FIG. 1 to a larger scale, whereby two parts have been cut out from the accessory.

FIGS. 1 to 5 represent an accessory 1 according to the invention, together with a wall part 2 of a file 3 which is not represented as a whole. The wall part 2 consists of a relatively rigid material, such as cardboard.

The accessory 1 mainly consists of a holder 4 upon which is provided a binding mechanism 5 and which is provided with means 6 which enable the holder 4 to be manually fixed to the file 3.

The binding mechanism 5 is of the type comprising elements, in particular rings 7, over which documents 8 provided with openings 9 can be threaded. The rings 7 are produced in the conventional manner. They have a predominantly rigid shape and each consist of at least two parts 10–11 provided on a base element 12 and which can be moved between an open and a closed condition. This base element 12 preferably comprises a snap-in system known as such which allows the parts 10–11 to be moved to and fro over a dead centre by exerting a force in order to put them in an open, closed position respectively. It is clear that, according to a variant, the base element 12 may also comprise other systems, such as for example a lever-operated system.

In the example from FIGS. 1 to 5, the binding mechanism 5 is mounted fixed on the holder 4, by means of rivets 13. According to a variant which is not represented, the binding mechanism 5 can also be mounted on the holder 4 in a detachable and replaceable manner.

The holder 4, in particular the above-mentioned means 6, are configured such that the holder 4 can be provided over the edge 14 of the wall part 2. To this end, the holder 4 is mainly made as a U-shaped body which can be pushed over the edge 14.

The U-shaped holder 4 hereby comprises a part 15 which is situated in a first plane 16 and a part 17 which is situated in a second plane 18, as well as a back part 19 connecting the parts 15 and 17. The parts 15 and 17 form the legs of the U-shape and define contact surfaces 20–21 on their sides turned towards one another, situated parallel to one another at a mutual distance D1 which corresponds or practically corresponds to the thickness D2 of the wall part 2 for which the accessory 1 has been designed.

The part 15 is made as a supporting plate, designed to lie against the wall part 2, such that a stable support is offered and the binding mechanism 5 will not tilt in relation to the wall part 2.

The part 17 forms an elastically bendable part and is provided with unitary parts, in this case two round pins 22 with beveled far ends 23, which can work in conjunction with openings 24 in the wall part 2, in this case in the shape of round perforations. These pins 22 thus form locking means which enable the holder 4, as will be explained hereafter, to be held in place in relation to the file 3.

The working and use of the accessory 1 can be easily derived from FIGS. 1 to 5.

Figure 3:
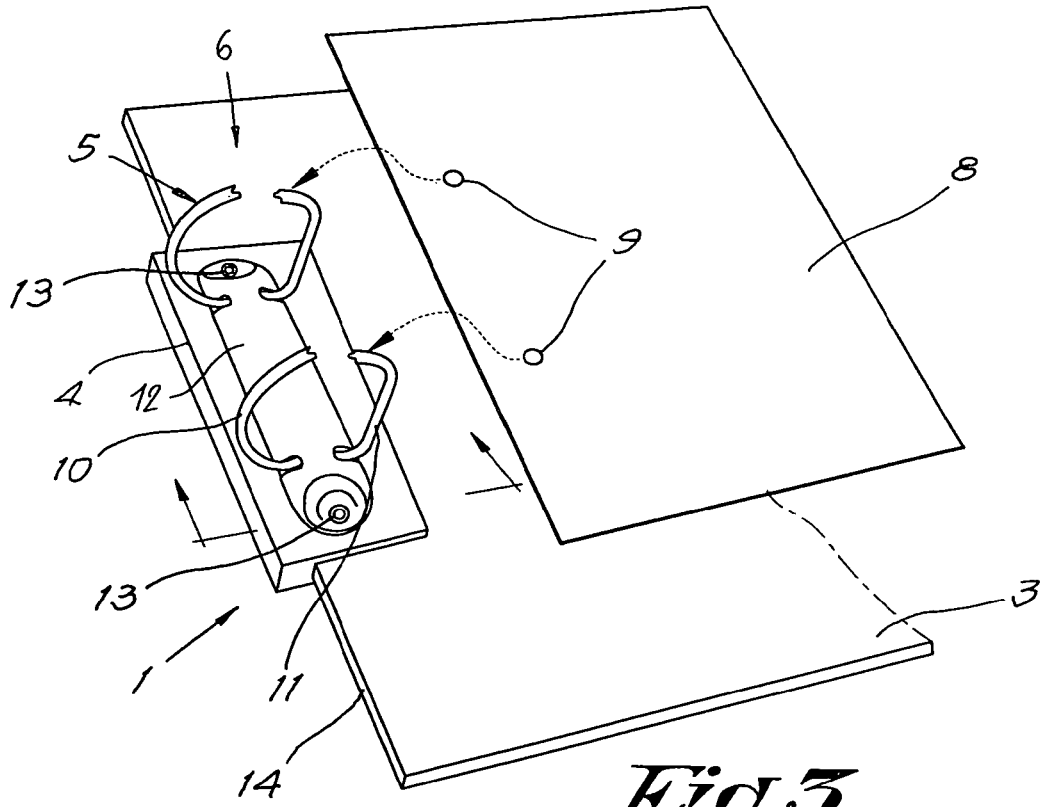
FIG. 3 is a view analogous to that in FIG. 1, but for the mounted condition of the accessory.
Figure 4:
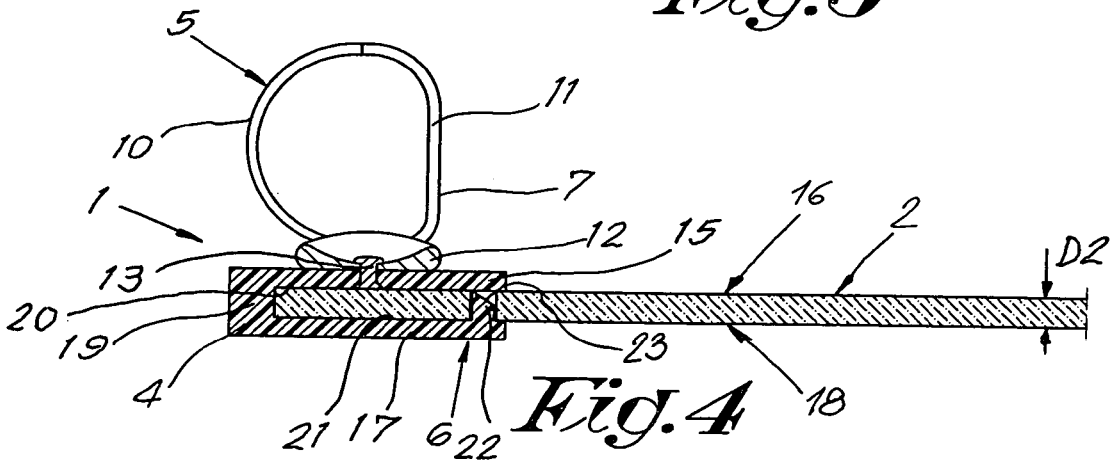
FIG. 4 represents a section according to line IV—IV in FIG. 3.
Figure 5:
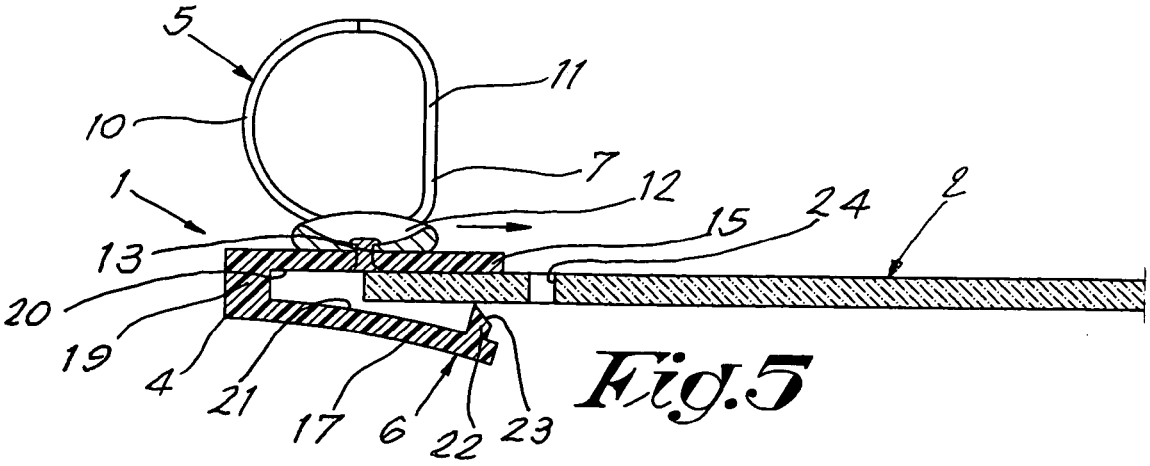
FIG. 5 represents a section as in FIG. 4, but while the accessory is being applied.

In order to fix the accessory 1 on the wall part 2, the part 17 is elastically bent open and, subsequently, as represented in FIG. 5, is pushed as of the edge 14 over the wall part 2 concerned, until the pins 22 mesh in the openings 24 as the part 17 springs back elastically, as a result of which a locked condition is created, as represented in FIGS. 3 and 4.

The distance at which the openings 24 are situated from the edge 14 is preferably selected such that the holder 4 ends up with its back part 17 against said edge 14, which contributes to the stability of the fixing.

After the holder 4 has been fixed to the file 3, the file 3 can be used as a ring file.

Figure 6:
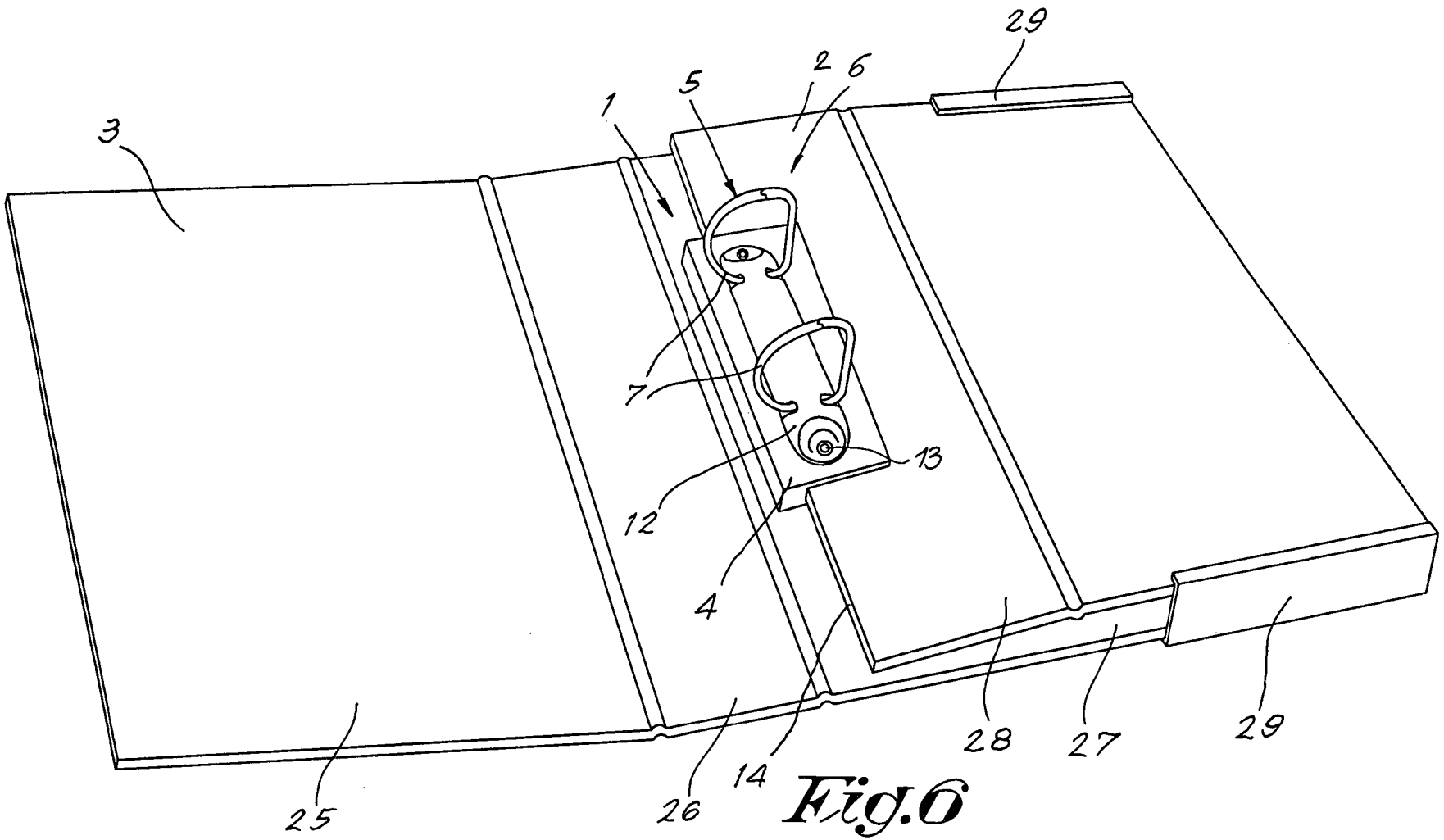
FIG. 6 represents a file equipped with the accessory from FIGS. 1 to 5.

FIG. 6 represents a practical application, whereby the accessory 1 according to the invention is provided to a file 3 of the type consisting of a front wall part 25, a rear wall part 27 connected to the latter by means of a back part 26 and at least one inwardly folded flap 28 formed on one of the aforesaid wall parts, in this case on the rear wall part 27, which is held at a distance from the accompanying wall part 27 via side pieces 29 which can preferably be mounted separately. The holder 4 is hereby mounted on the free edge 14 of the flap 28, whereby in an analogous manner as described above with reference to FIGS. 1 to 5, the flap 28 naturally is also provided with holes 24. As explained in the introduction, the accessory is particularly advantageous for this type of files.

Figure 7:
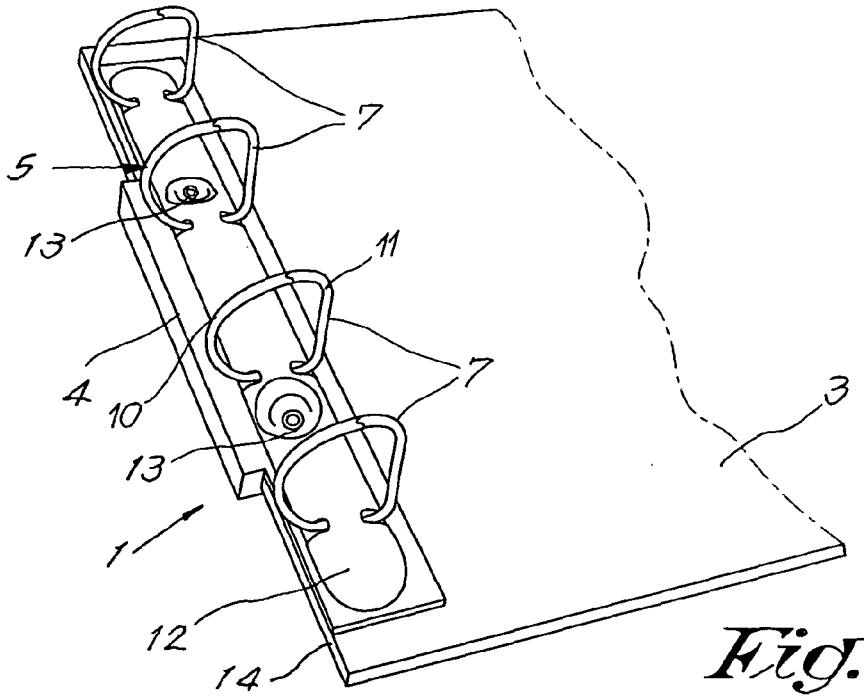
FIGS. 7 and 8 represent two variants.

It is clear that the invention is not restricted to binding mechanisms 5 with two rings 7. FIG. 7 represents for example a variant with four rings 7.

Also, instead of round openings 24 and round parts or pins 22, holes and co-operating parts in other shapes can be applied. In the embodiment from FIG. 8, use is made of longitudinal openings 30 as well as longitudinal parts 31 which can take place in said openings 30.

Figure 8:
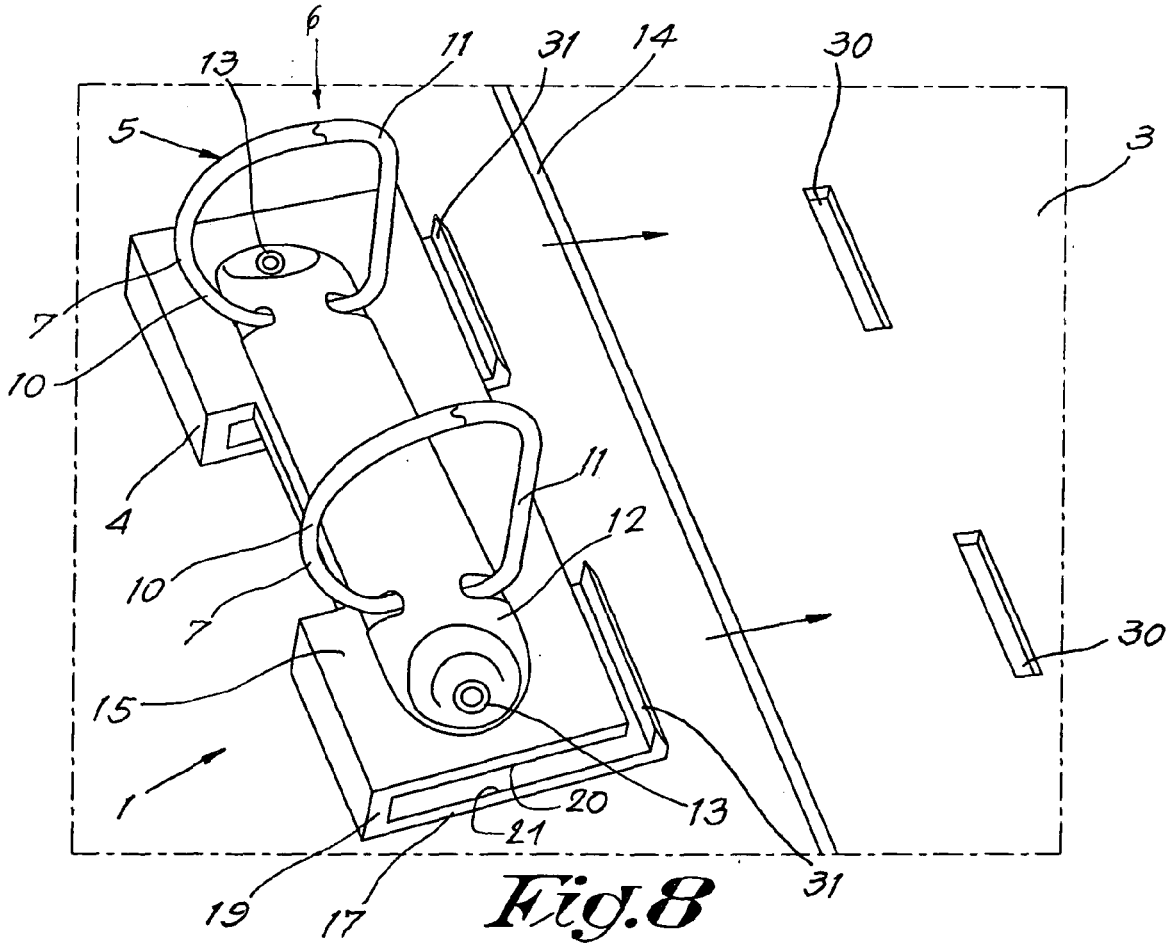

In the embodiment from FIG. 8, the parts 31 are each provided on a separate elastically bendable part 17.

It is clear that the holder 4 must not necessarily be U-shaped and that the means 6 and, in particular the locking means used thereby to keep the holder 4 in its position in relation to a file 3, can be made according to a large number of variants.

Figure 9:
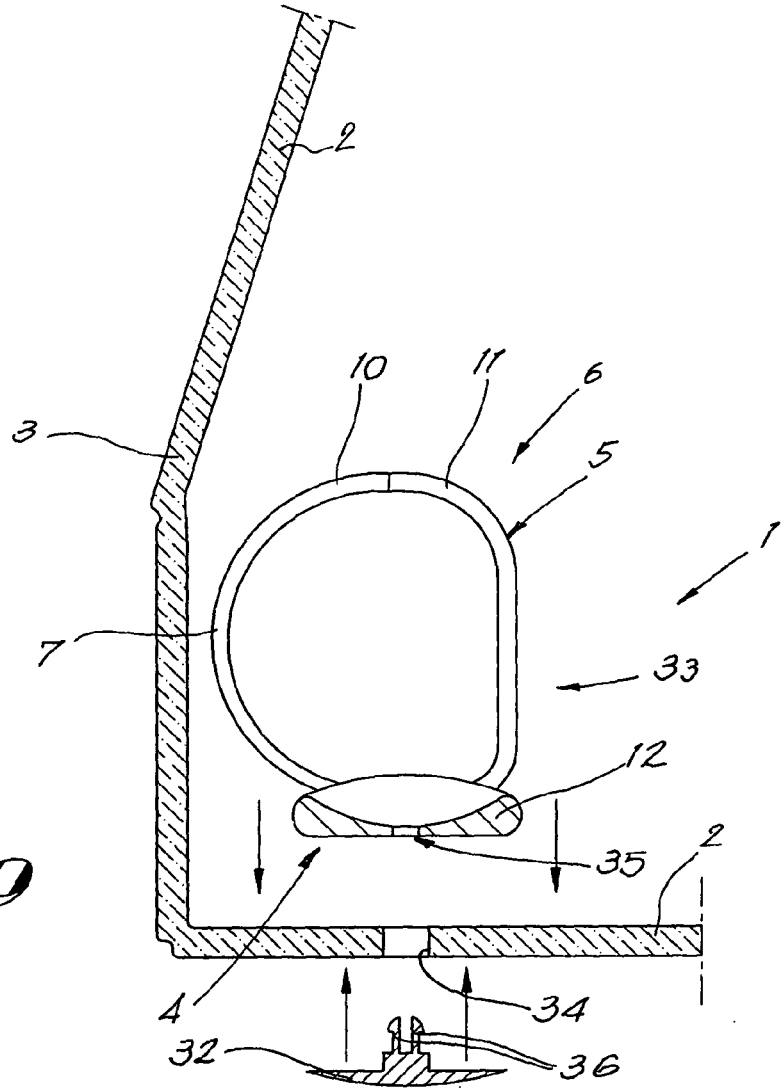
FIGS. 9 and 10 represent a section of another variant of the invention, in a dismounted and mounted condition respectively.
Figure 10:
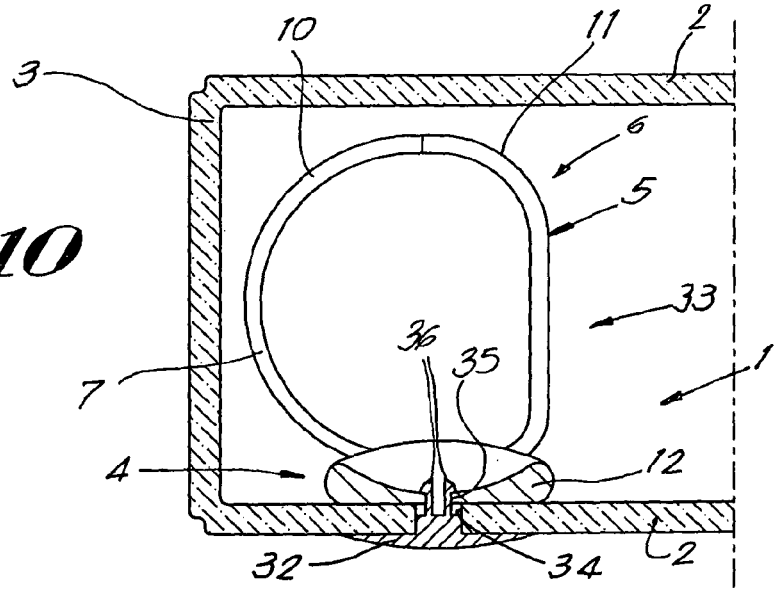

As an illustration, a variant is represented in FIGS. 9 and 10 whereby the holder 4 consists of two separate parts 32–33 which can be provided on either side of a wall part 2 of a file 3 and which can be snapped into one another through holes 34 provided therein by means of coupling parts 35–36.

The variant from FIGS. 9 and 10 also shows that the base element 12 onto which the rings 7 are fixed simultaneously serves as part 32 of the holder. It is clear, however, that according to a variant of the embodiment from FIGS. 9 and 10, the base element 12 could also be fixed on a separate support first, which then assumes the function of the part 32.

The invention is by no means limited to the above-described embodiments given as an example and represented in the accompanying drawings; on the contrary, such an accessory, as well as the files which can be equipped with such an accessory, can be made in different shapes and dimensions while still remaining within the scope of the invention.

The invention claimed is:

1. An accessory for a writing board, a file or the like, comprising a holder which can be provided to a file or the like wherein said holder includes a predominantly U-shaped body with legs that define contact surfaces on their sides turned toward one another, the holder working in conjunction with a binding mechanism of the type comprising elements over which documents that are provided with openings are threaded, at least one of the legs of the U-shaped body being elastically bendable and including unitary locking means, the locking means shaped to engage is configured to mesh in an opening in the file or the like by bending one of the legs away from the other leg so the holder is manually attached to a file or the like and fixed over an edge of a wall part of the file.

2. The accessory according to claim 1, wherein the abovementioned binding mechanism includes rings having a predominantly rigid shape, the rings including at least two parts provided on a base element and movable between an open and a closed position.

3. The accessory according to claim 1, wherein the U-shaped body of the holder can be provided over the file or the like in a clamping manner.

4. The accessory according to claim 1, wherein the binding mechanism is mounted fixed on the holder.

5. The accessory according to claim 1, wherein the binding mechanism is mounted on the holder in a replaceable manner.

6. The accessory according to claim 1, wherein the locking means for fixing the holder to a file or the like include detachable connecting means which allow for a removal and possibly a reuse.

7. The accessory according to claim 1, wherein the locking means consist of a snap in connection.

8. The accessory according to claim 1, wherein the holder comprises a supporting plate, designated to lie against a part of the file or the like, whereby the binding mechanism is configured to be mounted on this part.

9. The accessory according to claim 1, where the locking means includes a pin, which works in conjunction with openings in a file.

10. A writing board, file or the like, being equipped with a holder and a binding mechanism, as described in claim 1.

11. A writing board, file or the like, comprising provisions, in particular openings or the like, which make it possible to equip said file or the like with an accessory as described in claim 1.

12. An accessory for a writing board, a file or the like, comprising a holder which can be provided to a file or the like wherein said holder includes a predominantly U-shaped body with legs that define contact surfaces on their sides turned toward one another, the holder configured for working in conjunction with a binding mechanism of the type comprising elements over which documents that are provided with openings can be threaded, at least one of the legs of the U-shaped body being elastically bendable and situated opposite a leg which works in conjunction with the binding mechanism, and a unitary locking means in the form of a part that engages in an opening in the file or the like when the leg is bent away from the other leg so the holder is manually attached to a file or the like, at least one locking means part including a pin, which works in conjunction with openings in a file.

13. A writing board, file or the like of the type consisting of a front wall part, a rear wall part connected thereto by means of a back part and at least on inwardly folded flap formed on one of the aforesaid wall parts, which is held at a distance from the accompanying wall part via side pieces, and comprising a holder which includes a predominantly U-shaped body with legs that define contact surfaces on their sides turned toward one another, the holder working in conjunction with a binding mechanism of the type comprising elements over which documents that are provided with openings are threaded, at least one of the legs of the U-shaped body being elastically bendable and including a unitary locking means in the form of a part that engages or the like when the leg is bent away from the other leg so the holder is manually attached to a file or the like, whereby the holder is mounted on a free edge of the flap and whereby, near this free edge are at least provided means for providing such a holder on it.

* * * * *

UNITED STATES PATENT AND TRADEMARK OFFICE

CERTIFICATE OF CORRECTION

PATENT NO. : 7,097,378 B2
APPLICATION NO. : 10/620780
DATED : August 29, 2006
INVENTOR(S) : Guido Peleman It is certified that error appears in the above-identified patent and that said Letters Patent is hereby corrected as shown below:

Column 3, Line 10 reads "... without being limitative in any way, ..." and should read --... without being limiting in any way, ...--

Column 5, Lines 24-25, CLAIM 1, reads "... the locking means shaped to engage is configured to mesh ..." and should read --... the locking means shaped to engage ...--

Column 5, Last Line, CLAIM 8, reads "... designated to lie against a part ..." and should read --... designed to lie against a part ...--

Column 6, Line 30, CLAIM 13, reads "... and at least on inwardly folded flap ..." and should read --... and at least one inwardly folded flap ...--

Signed and Sealed this
Twenty-first Day of August, 2012

David J. Kappos

David J. Kappos
*Director of the United States Patent and Trademark Office*